US007152679B2

(12) United States Patent
Simpson

(10) Patent No.: US 7,152,679 B2
(45) Date of Patent: Dec. 26, 2006

(54) DOWNHOLE TOOL FOR DEFORMING AN OBJECT

(75) Inventor: Neil Andrew Abercrombie Simpson, Aberdeen (GB)

(73) Assignee: Weatherford/Lamb, Inc., Houston, TX (US)

( * ) Notice: Subject to any disclaimer, the term of this patent is extended or adjusted under 35 U.S.C. 154(b) by 379 days.

(21) Appl. No.: 10/119,630

(22) Filed: Apr. 10, 2002

(65) Prior Publication Data

US 2002/0157830 A1 Oct. 31, 2002

(30) Foreign Application Priority Data

Apr. 10, 2001 (GB) ..... 0108934.1

(51) Int. Cl.
*E21B 29/00* (2006.01)
*E21B 43/10* (2006.01)
*B21D 26/02* (2006.01)

(52) U.S. Cl. ..... 166/297; 166/298; 166/55; 166/222; 72/370.22

(58) Field of Classification Search ..... 166/297, 166/298, 55, 55.2, 207, 380, 169, 177.5, 166/55.1, 311, 312, 222; 73/56, 53, 370.22; 175/67

See application file for complete search history.

(56) References Cited

U.S. PATENT DOCUMENTS 2,526,695 A 10/1950 Schlumberger
2,918,125 A * 12/1959 Sweetman ..... 166/297
2,934,146 A * 4/1960 Laval, Jr. ..... 166/55
3,066,736 A * 12/1962 Venghiattis ..... 175/4.52
3,090,436 A * 5/1963 Briggs, Jr. ..... 166/63
3,115,932 A * 12/1963 Reynolds ..... 175/4.52
3,318,397 A * 5/1967 Combes ..... 175/73
3,708,121 A * 1/1973 Hall et al. ..... 239/99
3,858,649 A * 1/1975 Wray et al. ..... 166/162
3,897,836 A * 8/1975 Hall et al. ..... 175/93
3,921,427 A * 11/1975 Malone et al. ..... 72/59
4,064,703 A * 12/1977 Pogonowski ..... 405/224
4,214,854 A * 7/1980 Roeder ..... 417/402
4,227,348 A 10/1980 Demers
4,295,801 A * 10/1981 Bennett ..... 417/397
4,356,872 A * 11/1982 Hyland ..... 175/58
4,392,527 A 7/1983 Hauk et al.
4,416,593 A * 11/1983 Cummings ..... 417/344
4,619,129 A 10/1986 Petkov et al.
4,627,794 A * 12/1986 Silva ..... 417/225
4,640,355 A * 2/1987 Hong et al. ..... 166/269
4,788,843 A * 12/1988 Seaman et al. ..... 72/58
4,928,757 A 5/1990 Schellstede et al.
5,020,600 A * 6/1991 Coronado ..... 166/387

(Continued)

FOREIGN PATENT DOCUMENTS

EP 0 580 056 1/1994

(Continued)

OTHER PUBLICATIONS

Search Report issued by the British Patent Office, dated Aug. 22, 2001, for application serial No. GB 0108934.1.

(Continued)

*Primary Examiner*—William Neuder
*Assistant Examiner*—Shane Bomar
(74) *Attorney, Agent, or Firm*—Patterson & Sheridan, LLP

(57) ABSTRACT

A downhole tool comprises a body defining a fluid chamber, a fluid outlet for directing fluid outwardly of the chamber, and an arrangement for producing a rapid reduction in the volume of the chamber, such that fluid in the chamber is displaced rapidly through the outlet. The fluid may be utilised to deform or perforate a surrounding tubular.

66 Claims, 3 Drawing Sheets

U.S. PATENT DOCUMENTS

| | | | | | |
|---|---|---|---|---|---|
| 5,107,943 | A | | 4/1992 | McQueen et al. | 175/267 |
| 5,226,494 | A | | 7/1993 | Rubbo et al. | 166/250 |
| 5,267,617 | A | * | 12/1993 | Perricone et al. | 166/387 |
| 5,297,633 | A | * | 3/1994 | Snider et al. | 166/387 |
| 5,316,087 | A | | 5/1994 | Manke et al. | 166/381 |
| 5,333,698 | A | * | 8/1994 | Van Slyke | 175/65 |
| 5,381,631 | A | | 1/1995 | Raghavan et al. | |
| 5,392,850 | A | * | 2/1995 | Cornette et al. | 166/51 |
| 5,445,220 | A | | 8/1995 | Gurevich et al. | |
| 5,473,939 | A | * | 12/1995 | Leder et al. | 73/152.12 |
| 5,509,480 | A | | 4/1996 | Terrell et al. | 166/297 |
| 5,524,466 | A | * | 6/1996 | Coe | 72/62 |
| 5,632,604 | A | * | 5/1997 | Poothodiyil | 417/225 |
| 5,785,120 | A | * | 7/1998 | Smalley et al. | 166/55 |
| 5,924,489 | A | * | 7/1999 | Hatcher | 166/298 |
| 6,145,595 | A | * | 11/2000 | Burris, II | 166/374 |
| 6,155,343 | A | | 12/2000 | Nazzal et al. | |
| 6,155,361 | A | | 12/2000 | Patterson | |
| 6,289,998 | B1 | * | 9/2001 | Krueger et al. | 175/25 |
| 6,439,307 | B1 | * | 8/2002 | Reinhardt | 166/264 |
| 6,478,107 | B1 | * | 11/2002 | Birchak et al. | 181/113 |

FOREIGN PATENT DOCUMENTS

| | | |
|---|---|---|
| EP | 1368554 | 9/2002 |
| GB | 1 565 005 | 4/1980 |
| GB | 2 081 344 | 2/1982 |
| GB | 2 345 935 | 7/2000 |
| SU | 1360854 | 12/1987 |
| WO | WO 98/54433 | 12/1998 |
| WO | WO 00/37772 | 6/2000 |

OTHER PUBLICATIONS

PCT Search Report, International Application No. PCT/GB 02/01654, dated Oct. 11, 2002.

U.K. Search Report, Applicaiton No. GB 0323504.1, dated Jan. 10, 2005.

* cited by examiner

DOWNHOLE TOOL FOR DEFORMING AN OBJECT

FIELD OF THE INVENTION

This invention relates to a downhole tool for use in deforming a downhole object such as a tubular. In one embodiment, the present invention relates to a tubing hanger-forming tool.

BACKGROUND OF THE INVENTION

In the oil and gas exploration and production industry there is often a requirement to secure a length of bore-lining tubing to an existing section of tubing. One such arrangement is known as a hanger, and is used to, for example, suspend a section of liner to the lower end of an existing section of casing. Conventional liner hangers employ mechanical slips and the like, however more recent proposals have described the creation of hangers by expanding the upper end of a liner into engagement with the surrounding casing, as described in WO00/37772, the disclosure of which is incorporated herein by reference.

It is amongst the objectives of embodiments of the present invention to provide an alternative method and apparatus for creating a liner hanger, and to provide a tubing expansion tool.

It is amongst further objectives of embodiments of the invention to provide alternative methods and apparatus for deforming objects downhole.

SUMMARY OF THE INVENTION

According to a first aspect the present invention there is provided a downhole tool comprising a body defining a fluid chamber, a fluid outlet for directing fluid outwardly of the chamber, and volume reducing means for producing a rapid reduction in the volume of the chamber such that fluid in the chamber is displaced rapidly through the outlet.

The rapid displacement of fluid from the chamber may be employed to deform a downhole object, which may in particular comprise a tubular member. The tubular member may comprise an inner tube for coupling to a larger diameter outer tube. The outer tube may comprise casing in a casing lined borehole, and the inner tube may be deformed into engagement with the casing to form a tubing hanger.

The present invention is therefore particularly advantageous in that it allows a tubing hanger to be created by providing a length of tube, locating the tube in the casing and directing the fluid displaced from the tool chamber towards an inner surface of the tubing. The forces created by the rapid displacement of the fluid deforms the inner tubing into engagement with the inner surface of the casing, and the deformed tube may then act as a tubing hanger.

Alternatively, the invention may be utilised to create a profile in tubing, or to secure a ring or short sleeve within existing tubing. In other embodiments, the invention may even be utilised to puncture or punch a hole in existing tubing.

Preferably, the volume reducing means includes a member moveably mounted in the body and defining a wall of the fluid chamber. The volume reducing means may further include a second member mounted in the body, which may be movable to impact on and move the first member. The second member may be moveable between a first position, spaced from the first member, and a second position, in contact with the first member.

It will therefore be understood that, in this embodiment, the rapid displacement of fluid from the chamber is achieved by rapidly moving the second member to impact the first member, which is then rapidly moved to reduce the volume of the fluid chamber and displace the fluid out of the chamber through the outlet.

Conveniently, the second member is initially restrained in the first position. The second member may be restrained by a shear pin or other release mechanism which is adapted to release the second member when, for example, a predetermined force is exerted on the second member. Alternatively, the release mechanism may be retractable or otherwise moveable to release the second member; for example, the mechanism may comprise a latch or key which is retracted in response to a signal sent from surface, or in response to the tool engaging a no-go or other bore restriction or profile.

The first member may similarly be releasably retained in an initial position.

Preferably, the second member is moveable in response to a fluid pressure force, and may selectively communicate with a fluid pressure source. The fluid pressure source may comprise fluid in the borehole. In a deep borehole, the hydrostatic pressure experienced by the tool may be in the order of several hundred atmospheres, such that by selectively exposing the second member to bore pressure, a large pressure force may be generated. This pressure force is preferably communicated to the second member via an energy storage medium, such as a spring or a compressible fluid, typically an inert gas such as Nitrogen.

Alternatively, the second member may be coupled to a fluid pressure source which has been charged with high pressure compressible fluid, such an Nitrogen or another inert gas. The charging may take place on surface, utilising, for example, bottled Nitrogen at 200–300 bar.

In another embodiment, the fluid pressure source may comprise a propellant; a firing pin may be released to initiate a reaction resulting in the production of a significant volume of high pressure gas.

A burst disk, valve or other arrangement may be provided between the fluid pressure source and the second member. Alternatively, or in addition, the second member may be initially retained in the first position.

Movement of the second member may therefore be achieved by providing pressurised fluid in the tool, to exert a fluid pressure force on the second member. In this manner, the tool may effectively self-contained, and may be mounted on a reelable support member such as slickline or wireline.

Preferably, the first and second members comprise respective first and second pistons. A face of the first piston may define the wall of the deforming fluid chamber. Conveniently, the first and second pistons are annular pistons, which may be mounted in an annular chamber defined by the body and through which the second piston is movable. In other embodiments cylindrical pistons may be more appropriate or convenient. Thus, one face of the first piston may define a first end wall of the piston-accommodating chamber, and the other face defining a wall of the deforming fluid chamber.

Conveniently, a second end of the piston chamber is coupled to a fluid pressure source, for selectively exposing one face of the second piston to an elevated pressure with respect to the other face of the piston.

Preferably, the first end portion of the piston chamber is under vacuum. Alternatively, the body may include a fluid communication port for opening the first end of the chamber to the exterior of the tool. In a further alternative, the first end portion of the piston chamber initially contains compressible fluid, typically Nitrogen or another inert gas, at surface atmospheric pressure.

In other embodiments the tool may be activated by means other than or in addition to applied fluid pressure, including an explosive charge, a precompressed spring, a jar or a falling mass.

Preferably, the body is tubular. The outlet may comprise an annular opening extending around the body of the tool, and the outlet may be adjustable in dimension. The body may include an adjustable member and the outlet may be defined between the adjustable member and a part of the body. The adjustable member may include a threaded nut or other member which may be rotated to vary the spacing between the adjustable member and the part of the body. This may be advantageous in optimising fluid flow through the outlet for particular applications.

Alternatively, the tool may include a plurality of outlets spaced around a perimeter of the body, to provide a predetermined distribution of the fluid during displacement from the body, and thus achieve a predetermined pattern of deformation of the object. The outlets may be evenly or unevenly spaced around a circumference of the body, and may be defined by castellations formed in the body.

In other embodiments, only a single directed outlet may be provided, to create a relatively small area of deformation.

Preferably, the outlet or outlets are in the form of nozzles.

According to a second aspect of the present invention, there is provided a downhole tool assembly comprising:

an object for location in a well; and a downhole tool comprising a body defining a fluid chamber, a fluid outlet for directing fluid outwardly of the chamber, and volume reducing means for producing a rapid reduction in the volume of the chamber such that fluid is displaced rapidly through the outlet to impinge upon and deform the object.

Conveniently, the object comprises a tubular member. In particular, the object may comprise an inner, first tube for location in an outer, second tube, such that the tool may be utilised to deform the inner tube into engagement with the outer tube. The inner tube may comprise a deformable tubing anchor for securing a length of tubing in the outer tube.

Thus, it will be understood that the invention may advantageously be used as a tubing anchor activating tool; the tool deforms an inner tube by displacing fluid from the chamber and directing the fluid towards the inner tube, which deforms the tube into engagement with an outer tube, securing the inner tube in the outer tube, to serve as a tubing hanger.

The inner tube forming the tubing anchor may comprise part of the length of tubing to be hung from the outer tube. Alternatively, the inner tube may be separate from the length of tubing and the length of tubing may be coupled to the inner tube. The inner tube may be for location in a length of casing forming the outer tube, such as borehole-lining casing.

In alternative embodiments the object may comprise existing downhole tubing, the tool being used to create a profile in the tubing or to puncture or perforate the tubing.

In still further embodiments the object may comprise a ring or a short sleeve, which may be run into the bore with the tool.

According to a third aspect of the present invention there is provided a method of deforming an object downhole, the method comprising:

providing a tool having a body defining a chamber and containing a fluid;

directing a fluid outlet from the chamber towards an object to be deformed; and rapidly reducing the volume of the chamber such that fluid is ejected from the chamber through the outlet and towards the object, and deforms the object.

Although not wishing to be bound by theory, it is believed that the sudden ejection of fluid from the chamber through the outlet at high pressure creates a travelling pressure wave which impacts the object to be deformed.

Preferably, the method further comprises the steps of:

providing an inner, first tube to be deformed;

locating the inner tube in an outer, second tube of larger internal diameter than the external diameter of the undeformed inner tube;

locating the tool in the inner tube; and deforming the inner tube into engagement with the outer tube.

The tube may be a ring, sleeve, or part of a hanger or packer.

The step of rapidly reducing the volume of the chamber may further comprise providing a member moveably mounted in the body and defining a wall of the chamber, and rapidly moving the member. Preferably, a second member is provided moveably mounted in the body, and the second member is impacted against the first member. Furthermore, the first and second members may be provided in the form of respective first and second pistons mounted in a second chamber in the body.

The volume of the chamber may be rapidly reduced by generating a pressure differential across the second member to move the second member and to impact the second member against the first member. Conveniently, the pressure differential is generated by exposing one face of the second piston to an elevated pressure with respect to the other face of the second piston. The second piston may be restrained against movement until the pressure differential across the second piston reaches a pre-determined level, or on receipt of an appropriate control signal.

The fluid may be directed through a plurality of outlets to distribute the ejected fluid around a perimeter of the object. Alternatively, the fluid may be directed through a single, annular outlet, or through a single unidirectional outlet.

According to a further aspect the present invention there is provided a downhole tool comprising a body defining a fluid chamber, a movable member in communication with the chamber, and volume reducing means for producing a rapid reduction in the volume of the chamber such that fluid in the chamber acts on the member to move the member rapidly outwardly of the tool body.

Preferably, the member is mounted to be normally retracted in the tool body, for example the member may be spring-mounted to the body.

The member may comprise a punch or a bolt.

According to a still further aspect of the present invention there is provided a method of striking an object downhole, the method comprising:

providing a tool having a body defining a chamber and containing a fluid, and a member movably mounted in the body and in communication with the chamber;

either rapidly reducing the volume of the chamber or increasing the pressure of the fluid such that the fluid in the chamber acts on the member and moves the member rapidly outwardly of the tool body; and impacting the moving member on a downhole object.

Preferably, the moving member deforms the object, and may puncture or perforate the member.

These embodiments of the invention may utilise volume reducing means similar to those described above.

BRIEF DESCRIPTION OF THE DRAWINGS

Embodiments of the present invention will now be described, by way of example only, with reference to the accompanying drawings, in which.

DETAILED DESCRIPTION OF THE DRAWINGS

Figure 1:
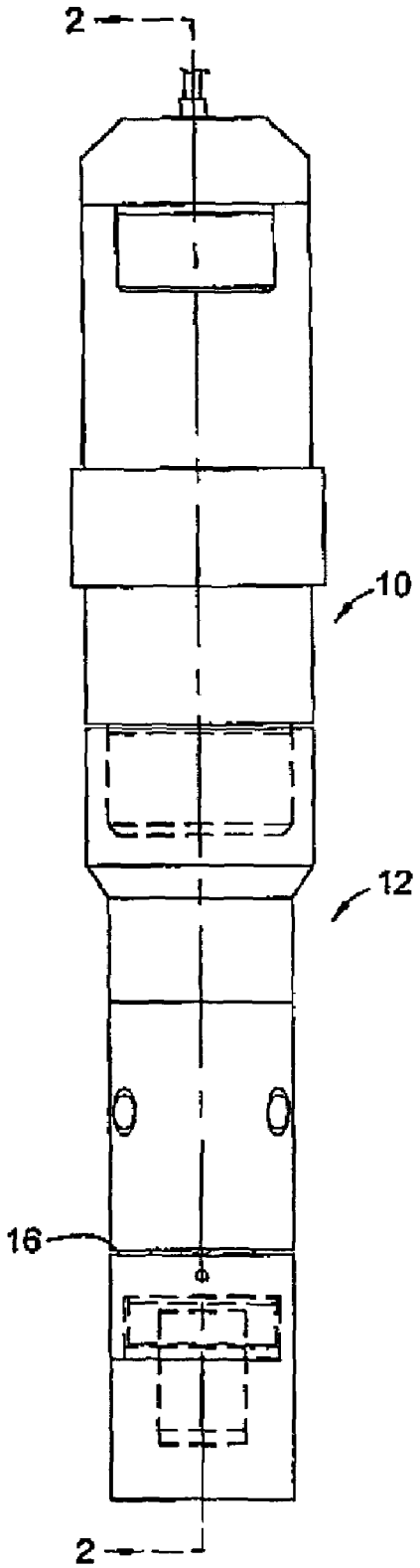
FIG. 1 is a view of a downhole tool in accordance with a preferred embodiment of the present invention, in the form of a hanger activating tool.
Figure 2:
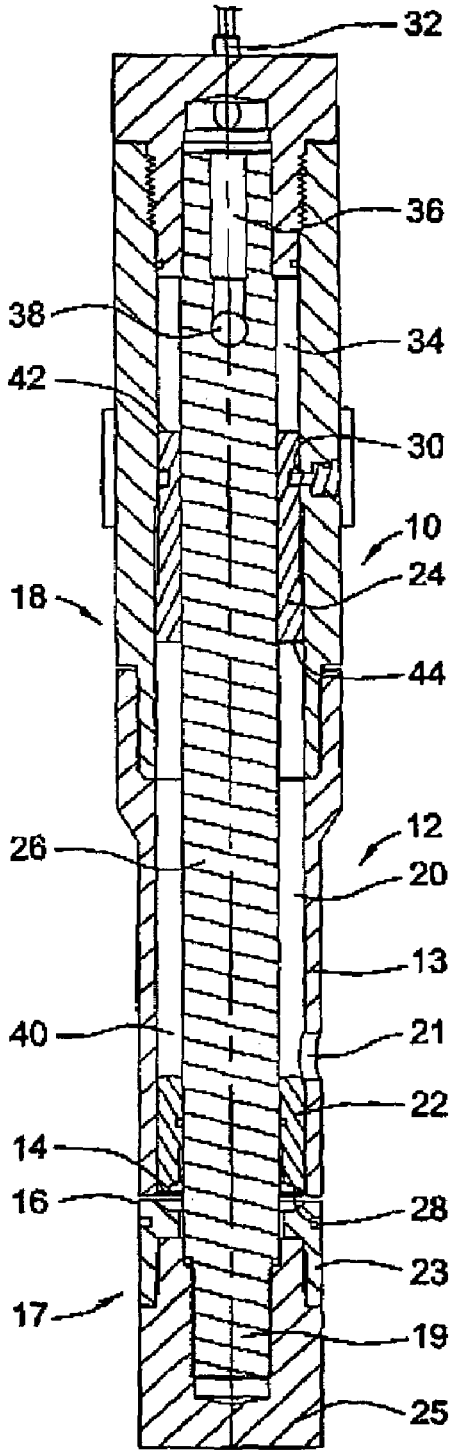
FIG. 2 is a longitudinal cross-sectional view of the tool of FIG. 1, taken along line 2—2 of FIG. 1.

Referring first to FIGS. 1 and 2, there is shown a downhole tool indicated generally by reference numeral 10. The tool 10 is shown in more detail in the longitudinal cross-sectional view of FIG. 2, which is taken on line 2—2 of FIG. 1. The tool 10 comprises a generally tubular body 12 which defines a fluid chamber 14, a fluid outlet 16 for directing fluid outwardly of the chamber 14 and volume reducing member or volume reducing means indicated generally by reference numeral 18. As will be described in more detail below, the volume reducing means 18 may be utilised to produce a rapid reduction in the volume of the fluid chamber 14, such that fluid is displaced rapidly through the outlet 16.

In the embodiment shown, the downhole tool 10 comprises a hanger activating tool for use in downhole environments to activate a tubing hanger. As will be understood by persons skilled in the art, a tubing hanger is used in situations where it is desired to suspend a length of tubing from an existing larger diameter tube. Typically, a hanger may be utilised to suspend a length of liner in a casing-lined borehole. The tool 10 is typically run into a borehole on coiled tubing, wireline, slickline or the like (not shown) to allow the tool to be easily tripped in and out of the borehole.

The body 12 is generally tubular and defines a second internal annular chamber 20. The volume reducing means includes a first member in the form of first annular piston 22 and a second member in the form of a second annular piston 24, each of which is moveably mounted in the body 12 around a central mandrel 26. The first piston 22 has a lower piston face 28 which defines an upper wall of the chamber 14. The second piston 24 is initially spaced from the first piston 22 and restrained from movement within the chamber 20 by a releasable pin 30.

The fluid chamber outlet 16 extends around the circumference of the body 12, and is in the form of an annular nozzle defined between a lower outer casing 13 of the body 12 an adjustable member 17 which includes a collar 23 and a threaded retaining nut 25. The collar 23 defines a lower wall of the fluid chamber 14,and is mounted on the nut 25, which in turn is mounted on the threaded end 19 of the mandrel 26. The nut 25 is rotatable on the shaft to vary the spacing between the lower casing 13 and the sleeve 23, and thus the dimension of the outlet 16.

The tool 10 is adapted to be coupled to a high pressure fluid supply through an input port 32 which communicates with an upper end 34 of the annular chamber 20 through a central passage 36 and flow port 38 in the mandrel 26. In use, the chamber upper end 34 is charged with high pressure (200-300 psi) inert gas, typically Nitrogen. The other, lower end 40 of the annular chamber 20 is under vacuum, having been evacuated through a closeable port 21 before running the tool.

Thus, an upper piston face 42 of the second piston 24 is exposed to an elevated pressure with respect to the lower piston face 44. This pressure differential creates a significant axial force on the piston 24 which, as will be described, may be utilised to move the second piston 24 downwardly, to impact the first piston 22.

Figure 3:
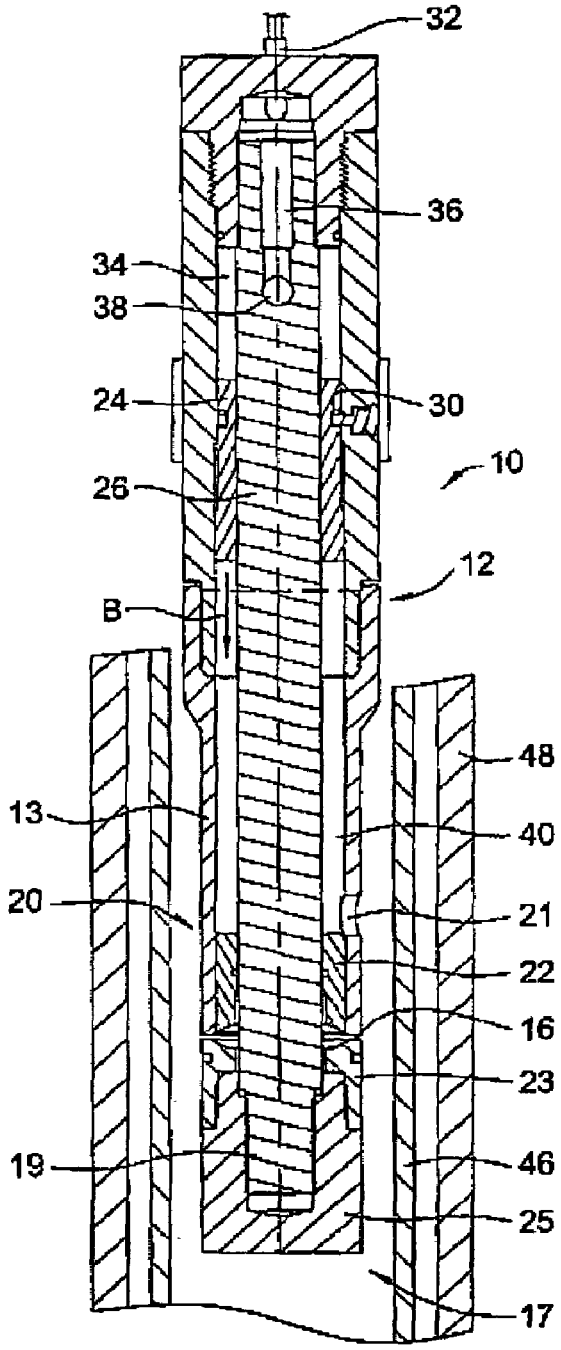
FIG. 3 is a view similar to FIG. 2, showing the tool in use, before activation.

Turning now also to FIG. 3, the tool 10 is shown located in an inner, first tube 46 which is to be coupled to an outer, second tube 48. The outer tube 48 is typically casing for lining the borehole of a well, whilst the inner tube 46 is a deformable tubing hanger, which is to be deformed into engagement with the outer tube 48. The hanger 46 may form part of a string of liner to be hung from the casing 48, or a string of liner may be coupled to the hanger 46.

Figure 4:
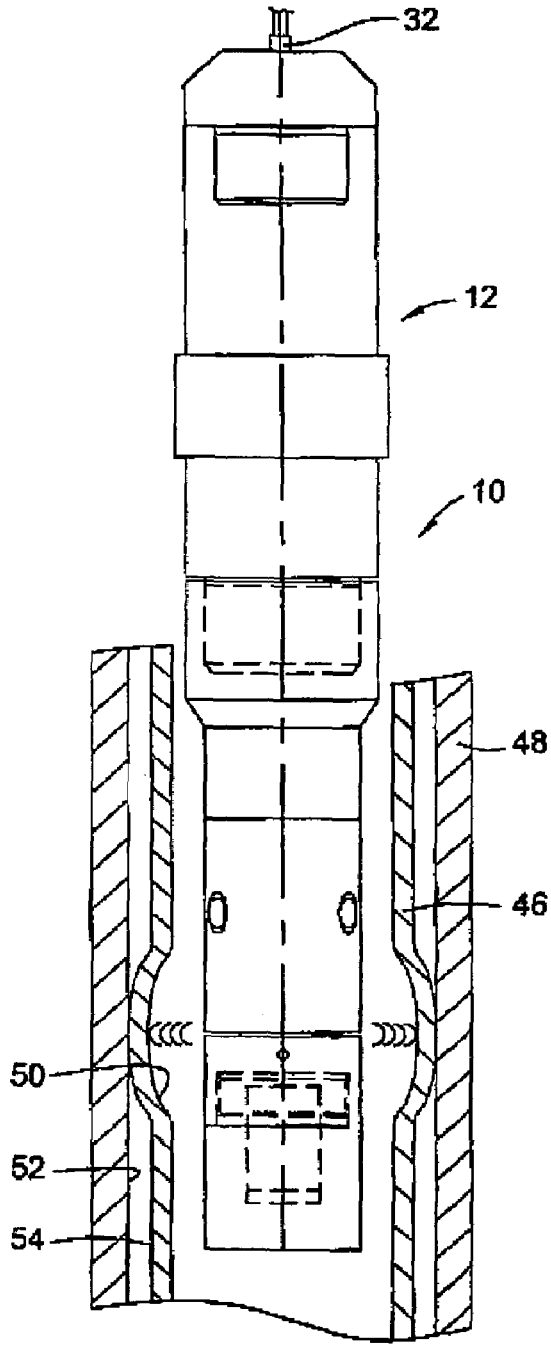
FIG. 4 is a view of the tool of FIG. 3, during activation.

FIG. 4 shows the activated tool 10, in the course of forming the hanger 46. As noted above, the high pressure gas in the upper end of the annular chamber 34 creates a differential pressure across the second piston 24. This generates a fluid pressure force upon the second piston 24, and on release of the pin 30 the elevated pressure of fluid in the upper chamber end 34, acting on the upper piston face 42, accelerates the unrestrained second piston 24 downwardly through the chamber 20, in the direction of the arrow B, to impact the first piston 22. The transfer of momentum causes the first piston 22 to move rapidly downwardly, displacing fluid from the chamber 14 and through the outlet 16.

As shown in FIG. 4, the incompressible well bore fluid is displaced through the outlet 16 in the direction C, creating a high pressure wave travelling radially outward to impinge upon an inner surface 50 of the tubing hanger 46, plastically deforming the inner tube into engagement with the inner surface 52 of the casing 48. The outer surface 54 of the hanger 46 carries carbide chips on the outer surface in the area to be deformed, to provide secure engagement with the casing inner surface 52. The hanger 46 is thus set in the casing 48. The tool 10 is then retrieved to surface and the desired well operations may proceed through the liner tubing 46 which is now secured in the casing 48.

It will be understood that references herein to "upper" and "lower" ends of the annular chamber are for ease of reference in the accompanying drawings. In use, in particular in deviated wells, the orientation of the tool may be such that the ends of the annular chamber are not located in upper and lower positions as shown in the drawings.

Various modifications may be made to the foregoing embodiments within the scope of the present invention. For example, the lower end 40 of the annular chamber 20 may initially contain low pressure fluid which is compressed or exhausted from the body 12 through the port 21 as the second piston 24 moves through the chamber. Alternatively, the lower end of the annular chamber 40 may contain a fluid, in particular a gas, at surface atmospheric pressure and may be sealed at the surface before the tool 10 is run into the borehole. In a further alternative, the lower end portion of the annular chamber 40 may be open to the exterior of the tool, such that fluid in the chamber 20 experiences annulus pressure.

The fluid pressure source for supplying pressurised fluid to the upper end 34 of the annular chamber 20 may comprise the head of fluid in the borehole; in a deep bore, the column of fluid in the bore may produce a significant hydrostatic pressure, which may be further increased by the action of surface or downhole pumps. Such fluid pressure may be communicated to a chamber above the second piston containing a compressible gas spring via a floating piston.

The fluid chamber 14 as described above is open to the exterior of the tool and fills with well fluid as the tool is lowered into The bore. However, in other embodiments the chamber 14 could be initially filled with gel or other fluid, which fluid could be contained in the chamber 14 by a frangible barrier.

Figure 5:
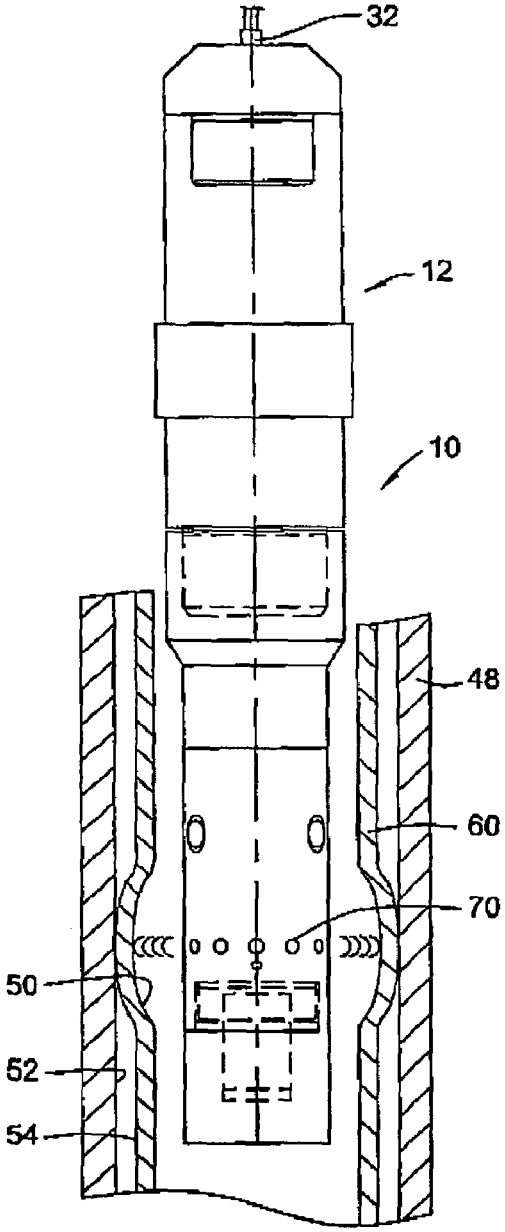
FIG. 5 is a view of the tool with a plurality of outlets.

In other embodiments the tool may be utilised to deform existing tubing to, for example, create a tool-locating profile. Alternatively, the tool 10 may include the chamber outlet or a plurality of outlets 70 to deform and locate a ring 60 as illustrated in FIG. 5 or sleeve in a bore. The ring 60 may serve to locate tools or devices, and the sleeve may serve a variety of purposes and may, for example, form the upper part of a packer.

Figure 6:
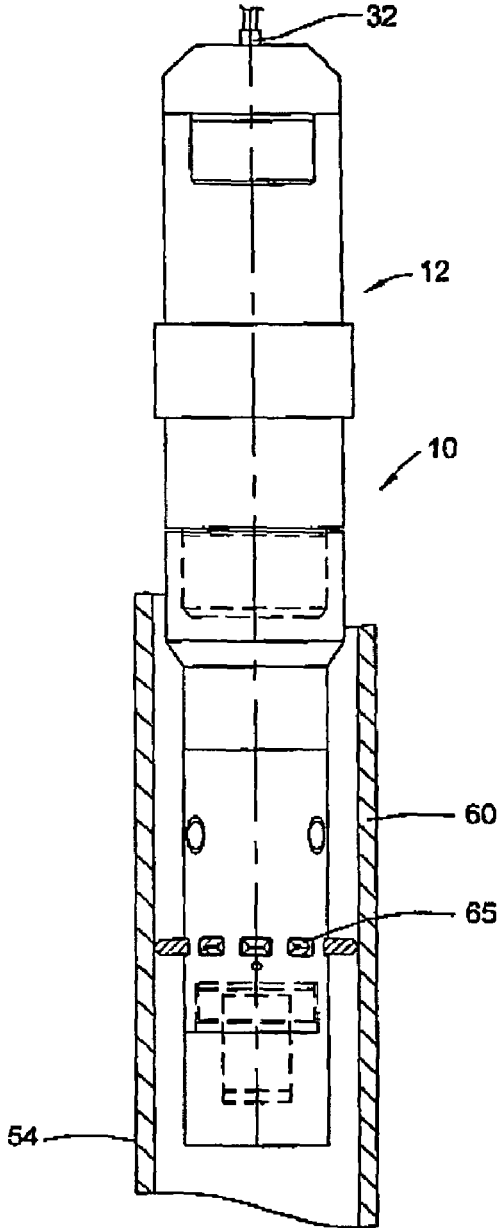
FIG. 6 is a view of the tool with an extendable memher.

Furthermore, in certain embodiments of the invention the deformation may not be achieved by a travelling pressure wave, but by a member 65 as illustrated in FIG. 6, such as a bolt, which is acted upon by the fluid in the chamber to move rapidly from the tool to, for example, punch a hole in existing casing.

Finally, the above described embodiments of the invention are described in relation to downhole applications, however the various aspects of the present invention may also be utilised in other applications.

The invention claimed is:

1. A downhole tool comprising:

a body defining an annular fluid chamber, at least one fluid nozzle for directing fluid outwardly of the chamber, and a volume reducing member constructed and arranged for producing a rapid reduction in the volume of the fluid chamber, thereby rapidly displacing a fluid in the fluid chamber through the at least one nozzle, wherein the volume reducing member includes a first member movably mounted in the body and defining a wall of the fluid chamber and a second member mounted in the body, the second member being movable to impact and move the first member.

2. The downhole tool as claimed in claim 1, wherein the second member is movable between a first position spaced from the first member, and a second position in contact with the first member.

3. The downhole tool as claimed in claim 2, wherein the second member is initially restrained in the first position.

4. The downhole tool as claimed in claim 1, wherein the second member is movable in response to a fluid pressure force.

5. The downhole tool as claimed in claim 1, wherein the first and second members comprise respective first and second pistons, a face of the first piston defining a wall of the fluid chamber.

6. The downhole tool as claimed in claim 5, wherein the first and second pistons are mounted in a piston chamber defined by the body.

7. The downhole tool as claimed in claim 6, wherein one end portion of the piston chamber is adapted to contain compressible fluid at elevated pressure, for exposing one face of the second piston to an elevated pressure with respect to the other face of the second piston.

8. The downhole tool as claimed in claim 7, wherein the other end portion of the piston chamber is under vacuum.

9. The downhole tool as claimed in claim 7, wherein the body includes a fluid communication port for opening the other end portion of the piston chamber to the exterior of the tool.

10. The downhole tool as claimed in claim 7, wherein the other end portion of the piston chamber initially contains fluid at surface atmospheric pressure.

11. The downhole tool as claimed in claim 5, wherein the first and second pistons are annular pistons mounted in an annular piston chamber defined by the body.

12. The downhole tool as claimed in claim 1, wherein a single, radially directed nozzle is provided.

13. The downhole tool as claimed in claim 1, wherein a single, annular nozzle is provided.

14. The downhole tool as claimed in claim 1, wherein a plurality of nozzles are provided and the nozzles are spaced around a perimeter of the body.

15. The downhole tool as claimed in claim 1, wherein the nozzle is adjustable in dimension.

16. A downhole tool assembly comprising:

an object for location in a well; and a downhole tool comprising a body defining a fluid chamber, a fluid outlet for directing fluid outwardly of the chamber, and volume reducing member for producing a rapid reduction in the volume of the chamber such that fluid is displaced rapidly through the outlet to impinge upon and deform the object, wherein the object is deformed circumferentially into substantial contact with a surrounding wellbore.

17. The downhole tool assembly as claimed in claim 16, wherein the object comprises a tubular member.

18. The downhole tool assembly as claimed in claim 17, wherein the tubular member is a ring.

19. The downhole tool assembly as claimed in claim 17, wherein the tubular member is a sleeve.

20. The downhole tool assembly as claimed in claim 17, wherein the object is initially mounted to the tool.

21. The downhole tool assembly as claimed in claim 16, wherein the object comprises an inner, first tube and the tool assembly further comprises an outer, second tube, wherein the inner, first tube is locatable in the outer, second tube.

22. The downhole tool assembly as claimed in claim 21, wherein the inner tube comprises a deformable tubing anchor.

23. The downhole tool assembly as claimed in claim 16, wherein the object is adapted to remain located in the well upon removal of the tool therefrom.

24. The downhole tool assembly of claim 16, wherein the fluid is wellbore fluid.

25. A method of deforming a first tubular into engagement with a second tubular, the method comprising:

locating the first tubular in the second tubular, the second tubular having a larger outer diameter than the first tubular, providing a tool in a wellbore, the tool having a body defining an annular chamber and containing a fluid;

locating the tool in the first tubular;

directing a fluid outlet from the chamber towards the first tubular;

rapidly reducing the volume of the chamber such that fluid is ejected from the chamber through the outlet and towards the first tubular; and deforming the first tubular into engagement with the second tubular.

26. The method as claimed in claim 25, wherein the first tubular is run into a bore together with the tool.

27. The method as claimed in claim 25, wherein the step of rapidly reducing the volume of the chamber further comprises providing a member movably mounted in the body and defining a wall of the chamber, and rapidly moving the member.

28. The method as claimed in claim 27, wherein the step of rapidly reducing the volume of the chamber further comprises providing a second member movably mounted in the body, and impacting the second member against the first member.

29. The method as claimed in claim 28, further comprising the step of exposing the second member to elevated fluid pressure.

30. The method of claim 29, further comprising initially charging the tool with high pressure fluid.

31. The method of claim 29, further comprising providing a high pressure volume source in the tool.

32. The method of claim 29, further comprising exposing the second member to bore pressure via an intermediate energy storage medium.

33. The method as claimed in claim 28, further comprising initially restraining the second member against movement towards the first member.

34. The method as claimed in claim 25, wherein the fluid is directed through a single outlet.

35. The method as claimed in claim 25, wherein the fluid is directed through a plurality of outlets.

36. The method as claimed in claim 25, wherein the fluid is directed radially of the tool.

37. The method as claimed in claim 25, wherein subsequent to the deformation of the object, the tool is relocated within the wellbore and/or removed from the wellbore and the object remains in the wellbore in the location in which it was deformed.

38. The method of claim 25, wherein deforming the tubular comprises creating a profile for engagement with the second tubular.

39. The method of claim 38, wherein the profile comprises a circumferential deformation.

40. The method of claim 25, wherein the first tubular comprises an expandable tubular.

41. The method of claim 25, wherein the first tubular comprises a liner.

42. The method of claim 25, wherein the first tubular comprises a packer.

43. The method of claim 25, wherein the first tubular comprises a hanger.

44. The method of claim 25, wherein the second tubular comprises a casing.

45. The method of claim 25, further comprising causing the first tubular to engage the second tubular at more than one location.

46. The method of claim 25, wherein subsequent to deforming the first tubular, the tool is relocated and/or removed and the first tubular remains in the location in which it was expanded.

47. The method of claim 25, wherein the tool is fluid pressure actuated.

48. A method of deforming a downhole object, the method comprising:

providing a tool having a body defining a chamber and containing a fluid;

activating a volume reducing member to reduce the volume in the chamber; and ejecting fluid from the chamber towards the object to create a traveling pressure wave of sufficient force to physically deform the object, wherein the object is deformed circumferentially into substantial contact with a surrounding wellbore.

49. The method of claim 48, wherein the fluid is wellbore fluid.

50. A downhole tool comprising:

a body defining a fluid chamber;

a movable member in communication with the chamber; and a volume reducing member for producing a rapid reduction in the volume of the chamber, the volume reducing member includes a first member movably mounted in the body and defining a wall of the chamber, wherein rapidly moving the first member to impact a second member movably mounted in the body causes a fluid in the chamber to move the movable member rapidly outwardly of the tool body.

51. The tool of claim 50, wherein the member is mounted to be normally retracted in the tool body.

52. The tool of claim 50, wherein the member comprises a punch.

53. The downhole tool of claim 50, wherein the fluid is wellbore fluid.

54. A method of striking an object downhole, the method comprising:

providing a tool having a body defining a chamber and containing a fluid, and a member movably mounted in the body and in communication with the chamber;

reducing the volume of the chamber by causing a first member movably mounted in the body to impact a second member movably mounted in the body such that the fluid in the chamber contacts the member and moves the member rapidly outwardly of the tool body; and impacting the moving member on a downhole object.

55. The method of claim 54, wherein the moving member deforms the object.

56. The method of claim 55, wherein the moving member perforates the object.

57. A method of deforming, the method comprising:

providing a tool having a body defining a chamber and containing a fluid;

directing a fluid outlet from the chamber towards an object to be deformed; and rapidly reducing the volume of the chamber by providing a member movably mounted in the body and defining a wall of the chamber, and rapidly moving the member to impact a second member movably mounted in the body, such that fluid is ejected from the chamber through the outlet and towards the object and deforms the object, wherein the object is deformed circumferentially into substantial contact with a surrounding wellbore.

58. The method of claim 57, wherein the fluid is wellbore fluid.

59. A downhole tool assembly comprising:

an object for location in a well, a body comprising one or more fluid chambers, a means for rapidly reducing the volume of a first one or more fluid chambers, thereby rapidly displacing a fluid contained in a second one or more fluid chambers, and a means for directing the rapidly displaced fluid to plastically deform the object into contact with a second downhole object through the force exerted by the rapidly displaced fluid.

60. The tool assembly of claim 59, wherein the second downhole object comprises a wellbore casing.

61. The tool assembly of claim 60, wherein the object for location in a well is an expandable tubular.

62. The tool assembly of claim 61, wherein the outer surface of the expandable tubular comprises carbide chips.

63. The tool assembly of claim 59, wherein the body of the tool is adapted to be separable from the object to be located in the well after said object is so located.

64. The downhole tool assembly of claim 59, wherein the fluid is wellbore fluid.

65. A downhole tool comprising:

a body defining an annular fluid chamber, at least one fluid outlet for directing fluid outwardly of the chamber, and a volume reducing member constructed and arranged for producing a rapid reduction in the volume of the fluid chamber, the volume reducing member having:

a first member movably mounted in the body and defining a wall of the fluid chamber; and a second member mounted in the body, the second member being movable to impact and move the first member, thereby rapidly displacing a fluid in the fluid chamber through the at least one outlet.

66. A downhole tool for expanding a tubular, comprising:

a body defining an annular fluid chamber, a single, annular outlet for directing fluid outwardly of the chamber, and a volume reducing member constructed and arranged for producing a rapid reduction in the volume of the fluid chamber, thereby rapidly displacing a fluid in the fluid chamber through the outlet to expand the tubular.

* * * * *